US006888517B2

(12) United States Patent
Ikemoto

(10) Patent No.: US 6,888,517 B2
(45) Date of Patent: May 3, 2005

(54) VIDEO DISPLAY APPARATUS AND DISPLAY METHOD

(75) Inventor: Yoshihiko Ikemoto, Tokyo (JP)

(73) Assignee: Pioneer Plasma Display Corporation, Izumi (JP)

( * ) Notice: Subject to any disclaimer, the term of this patent is extended or adjusted under 35 U.S.C. 154(b) by 275 days.

(21) Appl. No.: 09/862,918

(22) Filed: May 22, 2001

(65) Prior Publication Data

US 2002/0030673 A1 Mar. 14, 2002

(30) Foreign Application Priority Data

May 22, 2000 (JP) ..... 2000-150695

(51) Int. Cl.[7] ..... G09G 5/00
(52) U.S. Cl. ..... 345/67; 345/89
(58) Field of Search ..... 348/699; 350/140; 345/89, 22, 23, 212

(56) References Cited

U.S. PATENT DOCUMENTS 5,191,416 A 3/1993 Dickson et al.
6,008,790 A 12/1999 Shingu et al.
6,069,602 A * 5/2000 Tanaka et al. ..... 345/89
6,493,041 B1 * 12/2002 Hanko et al. ..... 348/699

FOREIGN PATENT DOCUMENTS

| | | |
|---|---|---|
| EP | 0 583 102 A1 | 7/1993 |
| JP | 4-196787 | 7/1992 |
| JP | 8-18888 | 1/1996 |
| JP | 8-248392 | 9/1996 |
| JP | 10-42259 | 2/1998 |
| JP | 2947400 | 7/1999 |
| WO | WO 00/01140 | 1/2000 |

* cited by examiner

*Primary Examiner*—Dennis-Doon Chow
*Assistant Examiner*—Srilakshmi K. Kumar
(74) *Attorney, Agent, or Firm*—Morgan, Lewis & Bockius LLP

(57) ABSTRACT

A video display driver circuit adapted to receive and monitor an input video signal, which is associated with information or an image that is subsequently displayed on a display. The video display driver circuit includes circuitry for detecting movement of the information or image displayed on the display and circuitry for adjusting a vertical synchronization frequency associated with the display to enable the moving information or image to be smoothly reproduced in a number of locations on the display.

8 Claims, 4 Drawing Sheets

VIDEO DISPLAY APPARATUS AND DISPLAY METHOD

BACKGROUND OF THE INVENTION

1. Field of the Invention

The present invention relates to a video display apparatus and a video display method, and more particularly to a video display apparatus that displays image data output from a personal computer at a frame frequency that is lower than the frame frequency of the personal computer.

2. Related Art

For example, in a plasma type video display apparatus having a dot display, it is generally desirable that the vertical synchronization frequency of the video signal in the display part be a low frequency. For this reason, in the case in which the vertical synchronization frequency of the input video signal is high, it is necessary to convert the frequency of the vertical synchronization signal so as to output it to the display part. Recently, personal computers are exhibiting a trend toward higher vertical synchronization frequencies, and an increase in the cases in which a moving image is input to a personal computer or the personal computer reproduces a moving image.

In the case in which a video signal output from a personal computer is input to a video display apparatus that makes a dot display, it is necessary to convert the vertical synchronization frequency. In a method used in the past, the video signal was subjected to the same vertical synchronization frequency conversion, regardless of whether the video signal was a still image or a moving image. Additionally, with regard to the thinning of frames, the interval for frame thinning was fixed, regardless of the condition of the video signal. For this reason, problems often arose such as the same image is displayed continuously, and the occurrence of non-continuities in a moving image.

Accordingly, it is an object of the present invention to improve on the above-noted drawbacks of the prior art, by providing a video display apparatus that detects movement information of an input video signal, and performs vertical synchronization frequency conversion suitable thereto, thereby enabling the smooth reproduction of a moving image, without the occurrence of non-continuities in the moving image.

SUMMARY OF THE INVENTION

To achieve the above-noted objects, the present invention adopts the following basic technical constitution.

Specifically, a first aspect of the present invention is a dot display type video display apparatus displaying an image having a first frame frequency at a second frame frequency that is lower than the first frame frequency, the video display apparatus comprising: a synchronization signal generation circuit for generating a synchronization signal of the second frame frequency; a conversion frequency detector for calculating a number of frames making up an unit block at each of the frame frequencies and a number of frames to be thinned based on the first frame frequency and the second frame frequency; a frame memory for storing a first frame having the first frame frequency; a difference detector for comparing intensity data of each dot on the video display apparatus of a second frame which is currently input to the video display apparatus with intensity data of each dot of the first frame which is stored in the frame memory and which is immediately before the second frame, and detecting a difference between the two frames; a difference adder for counting a number of dots for a case in which the difference of the intensity data detected by the difference detector is greater than a prescribed value; a movement detection/judgment section for distinguishing whether or not a count value detected by the difference adder is below a prescribed value and outputting a signal indicating that thinning of the second frame is possible, when the count value of the difference adder is below the prescribed value; and a frame thinning section for thinning the second frame, in a case in which the signal indicating that frame thinning of the second frame is possible is output from the movement detection/judgment section and also a signal indicating that the number of frames to be thinned is output from the conversion frequency detector.

A second aspect of the present invention is that the frame thinning section further comprising: a frame thinning means for executing frame thinning of the second frame; and a frame thinning stopping means for stopping the frame thinning operation of the frame thinning means within a current block including the first frame and the second frame, in a case in which, if, as a result of an execution of frame thinning by the frame thinning means, a total number of thinned frames has reached the number of frames to be thinned which is output from the conversion frequency detector.

In the third aspect of the present invention, an area detector for detecting movement of an image within a prescribed area on the video display apparatus is provided, and detection results of the area detector being output to the movement detection/judgment section.

In the fourth aspect of the present invention, the video display apparatus is a plasma display apparatus.

In the fifth aspect of the present invention, the video display apparatus is a liquid-crystal display apparatus.

DETAILED DESCRIPTION OF THE PREFERRED EMBODIMENTS

Embodiments of a video display apparatus according to present invention are described in detail below, with references made to relevant accompanying drawings.

Figure 1:
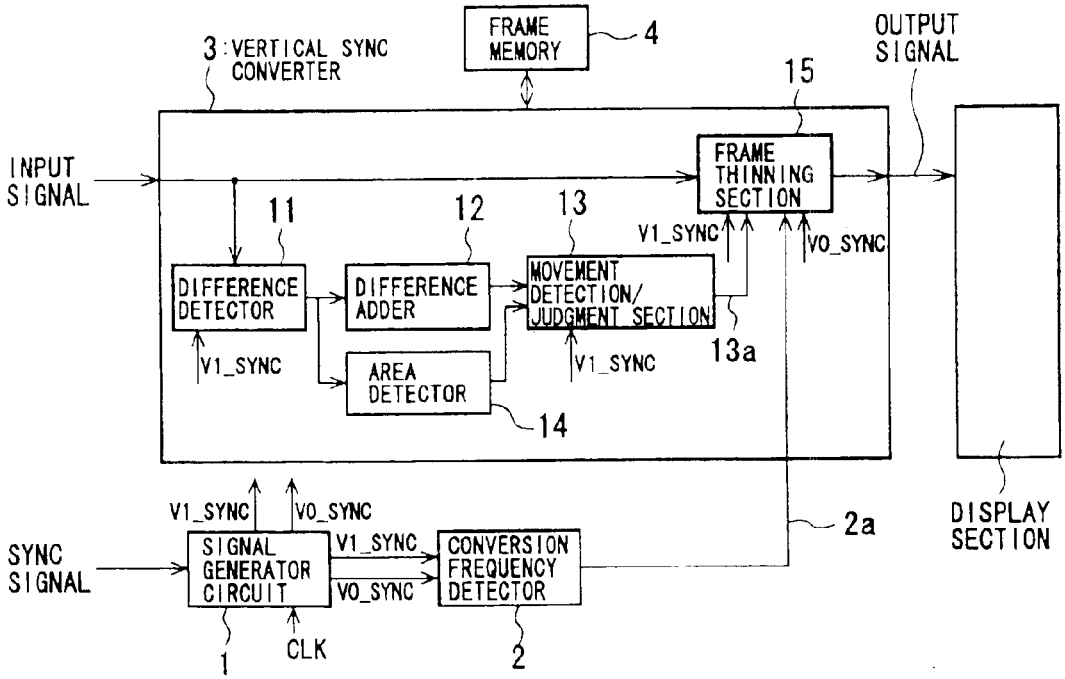
FIGS. 1(*a*) to 1(*c*) are block diagrams showing a video display apparatus according to the present invention.
Figure 1:
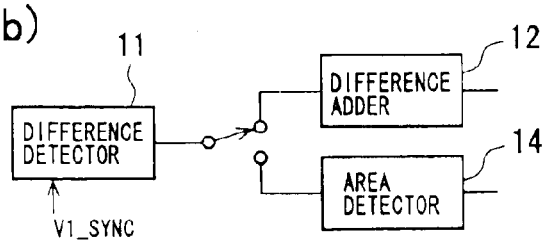
Figure 1:
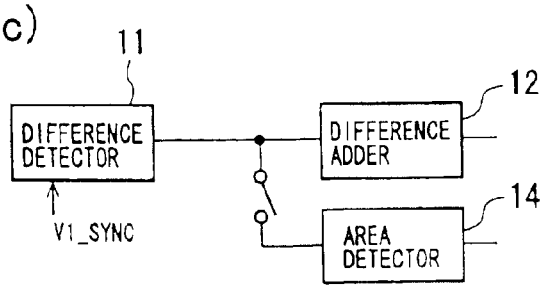
Figure 2:
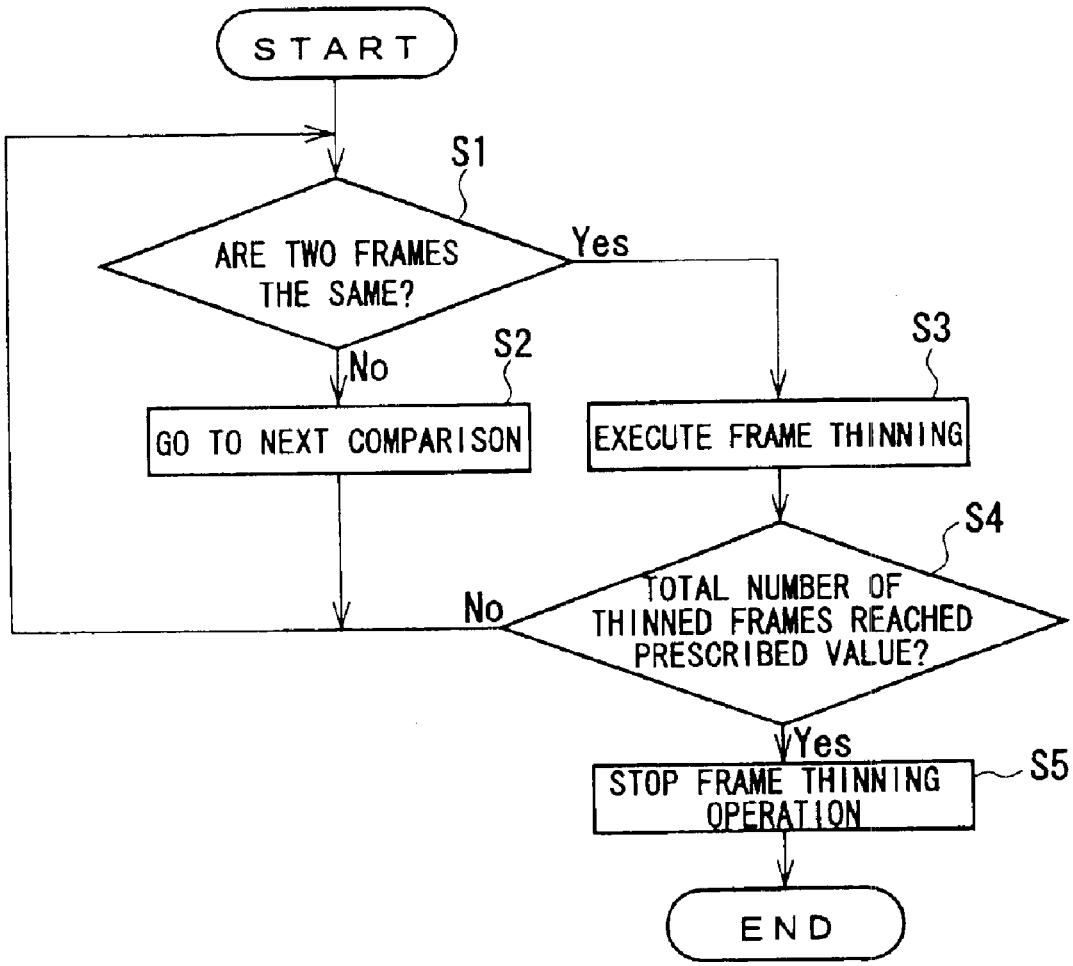
FIG. 2 is a flowchart illustrating frame thinning operation in the present invention.
Figure 3:
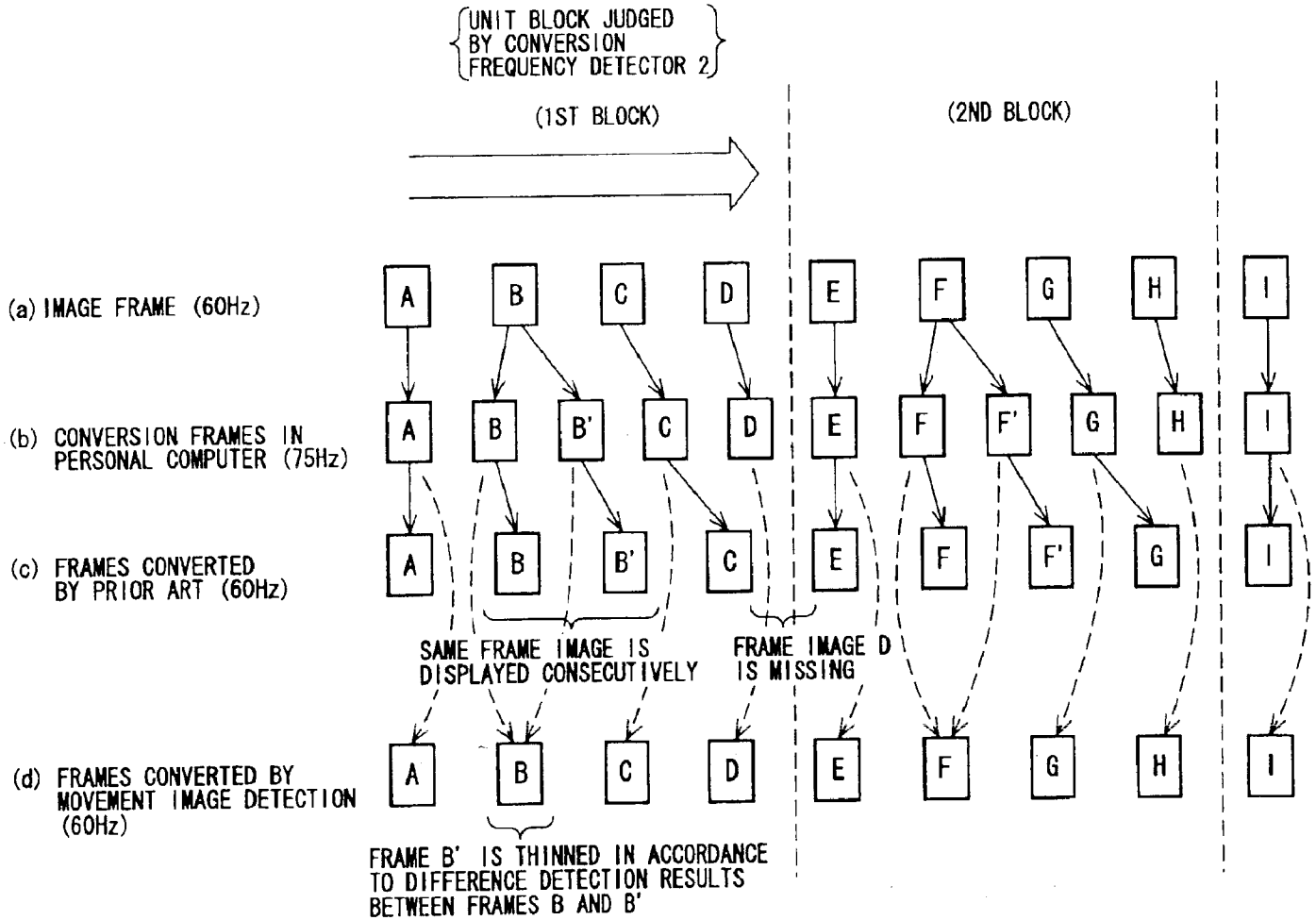
FIG. 3 is a drawing illustrating frame thinning operation of the present invention.

Specifically, FIG. 1 is a block diagram showing the configuration of a video display apparatus according to the present invention, FIG. 2 is a flowchart showing the frame thinning operation in the present invention, FIG. 3 is a drawing showing the relationship between original frames (a), frames (b) which are input to a video display apparatus of the present invention from a personal computer, frames (c) which are converted by the conventional system, and frames (d) which are converted by the system of the present invention.

These drawings show a dot display type video display apparatus displaying an image having a first frame frequency at a second frame frequency that is lower than the first frame frequency, the video display apparatus comprising: a synchronization signal generation circuit 1 for generating a synchronization signal of the second frame frequency (VO_SYNC); a conversion frequency detector 2 for calculating a number of frames making up an unit block at each of the frame frequencies and a number of frames to be thinned based on the first frame frequency (VI_SYNC) and the second frame frequency (VO_SYNC); a frame memory 4 for storing a first frame having the first frame frequency (VI_SYNC); a difference detector 11 for comparing intensity data of each dot on the video display apparatus of a second frame which is currently input to the video display apparatus with intensity data of each dot of the first frame which is stored in the frame memory 4 and which is immediately before the second frame, and detecting a difference between the two frames; a difference adder 12 for counting a number of dots for a case in which the difference of the intensity data detected by the difference detector 11 is greater than a prescribed value; a movement detection/judgment section 13 for distinguishing whether or not a count value detected by the difference adder 12 is below a prescribed value and outputting a signal 13*a* indicating that thinning of the second frame is possible, when the count value of the difference adder 12 is below the prescribed value; and a frame thinning section 15 for thinning the second frame, in a case in which the signal 13*a* indicating that frame thinning of the second frame is possible is output from the movement detection/judgment section 13 and also a signal 2*a* indicating that the number of frames to be thinned is output from the conversion frequency detector 2.

Additionally, these drawings show a video display apparatus minimally including a frame thinning means for thinning a frame (Step S3) in a case in which, when a difference detector compares image data of the second frame for which it is to be established whether or not to perform a frame thinning with image data of the first frame immediately before the second frame, and the movement detection/judgment section 13 detects that the image data of the two frames are the same, and a frame thinning stopping means (Step S5) for stopping the frame thinning operation of the frame thinning means within a current block including the first frame and the second frame, in a case in which, if, as a result of an execution of frame thinning by the frame thinning means, a total number of thinned frames has reached the number of frames to be thinned which is output from the conversion frequency detector (Step S4).

In this video display apparatus, an area detector 14 is provided which detects movement within a prescribed area on the video display apparatus, and the detection results output from this area detector 14 being input to the movement detection/judgment section 13.

In the above case, the video display apparatus of the present invention is either a plasma display apparatus or a liquid-crystal display apparatus.

The present invention is described in further detail below.

An original frame of the image having a frame frequency of 60 Hz shown in FIG. 3(*a*) is input to a personal computer, and converted to the image having a frame frequency of 75 Hz, the image data thereof being input to the video display apparatus of the present invention, this being shown in FIG. 3(*b*). As shown in FIG. 1, an input signal synchronization signal is input to the synchronization signal generation circuit 1, so as to generate a vertical synchronization signal (VI_SYNC) at 75 Hz. The synchronization signal generation circuit 1 also generates a vertical synchronization signal (VO_SYNC) at 60 Hz by using a clock signal CLK. The vertical synchronization signals (VI_SYNC) and (VO_SYNC) are input to a frequency detector 2, The frequency detector 2 detects the difference between the two different vertical synchronization signals, and calculates the number of frames for 1 block to each vertical synchronization signal, and the number of frames that are to be thinned for a frame conversion.

An input image signal is input to the vertical synchronization converter 3. The input image signal is stored in the frame memory 4, and a next input image signal is compared with the input image stored in the frame memory 4 by the vertical synchronization converter 3. That is, the vertical synchronization converter 3 detects the difference values of the intensities of each dot of the input frame and the previous frame stored in the frame memory 4. If this difference value is greater than a prescribed value, a signal 11*a* indicating that the difference value is greater than the prescribed value is output to the difference adder 12, and the number of such events is counted by the difference adder 12.

If the value counted by the difference adder 12 is smaller than a pre-established value, the movement detection/judgment section 13 judges that the two compared frames are the same image, and a signal 13*a* that indicates that the frame currently being received can be thinned is output from the movement detection/judgment section 13 to the frame thinning section 15. In this case, in the present invention a judgment is made by the area detector 14 of whether or not the detected difference values are concentrated in a specific square area, and the movement detection/judgment section 13 judges, based on the information received from the difference adder 12 and the area detector 14, whether the image is a still image or a moving image, and a signal indicating whether or not to perform a frame thinning of the currently received frame is generated, thereby enabling appropriate judgment of whether an image is a still image or a moving image.

Frame thinning is established by the frame thinning section 15, based on the signal 2*a,* which indicates the number of frames to be thinned as calculated by the conversion frequency detector 2 and the signal 13*a,* output from the movement detection/judgment section 13, which indicates whether it is possible to perform frame thinning with regard to a currently received frame, and after vertical frequency conversion processing is performed according to frame thinning, the video signal is output from the frame thinning section 15.

As shown in FIG. 2, in the present invention, a comparison is performed between a currently received frame and the immediately previous frame thereof (steps S1 and S2), and in the case in which, as a result of the frame thinning operation (step S3), the total number of frames thinned in one block has reached the number of frames to be thinned (step S4), the frame thinning operation within the current block is stopped (step S5), thereby enabling the thinning of just the required number of frames at all times.

The operation of the present invention is described in further detail below, with references made to FIG. 3.

An original image (FIG. 3(*a*)) having a vertical synchronization frequency of 60 Hz is input to a personal computer, within which the vertical synchronization frequency is converted to 75 Hz (FIG. 3(*b*)). The video signal output from the personal computer is input to the video display apparatus of the present invention, within which the vertical synchronization frequency is reconverted to 60 Hz for display.

FIG. 3(*c*) shows the method of the prior art, and FIG. 3(*d*) shows the results of conversion according to the present invention.

In the personal computer, in the case in which an input video signal having a vertical synchronization frequency of 60 Hz is converted to a video signal having a vertical synchronization frequency of 75 Hz, since it is necessary to display five frames of video signal in the time for four frames, the vertical synchronization frequency is converted by adding one frame. In the case of FIG. 3(*b*), a frame B', which is the same as frame B, is added.

If the video signal from the personal computer is to be input to a video display apparatus such as a plasma type video display apparatus, and reconverted to 60 Hz, because only four frames are displayed during the time for five frames, one frame is thinned. In the prior art as shown in FIG. 3(*c*), four frames from the start were mechanically displayed, with the fifth frame (frame D) being thinned. In this case, two frames (B→B') with the same picture can occur consecutively, and the information of frame D is missing, for example, causing non-continuities in a moving image. Thus, in the conventional method, it is not possible to restrict the thinning of frames, so that the actual frame to be thinned is indeterminate, depending on the particular timing, so that a moving image became non-continuous and the display was not smooth.

In contrast to the above, in the case of the present invention as shown in FIG. 3(*d*)), in accordance with the two different vertical synchronization frequencies, (VI_SYNC at 75 Hz) and (VO_SYNC at 60 Hz), the number of frames in one block required for vertical frequency conversion can be judged to be five frames before conversion and four frames after conversion, respectively, enabling calculation of the number of frames to be thinned. Because it is possible from the information of the movement detection/judgment section 13 to judge that there is little movement information between frame B and frame B', the movement detection/judgment section 13 outputs to the frame thinning section 15 a signal 13*a,* which indicates that it is possible to thin the frame B', and the frame thinning section 15, based on the signal 13*a* from the movement detection/judgment section 13 and the signal 2*a* from the conversion frequency detector 2, which indicates the number of frames to be thinned, executes processing for thinning the frame B'. In this specific example, because the number of frames to be thinned in one block is one frame, by stopping further frame thinning within this block, it is possible to reproduce a moving image continuously, with the sequence A→B→C→D.

Figure 4:
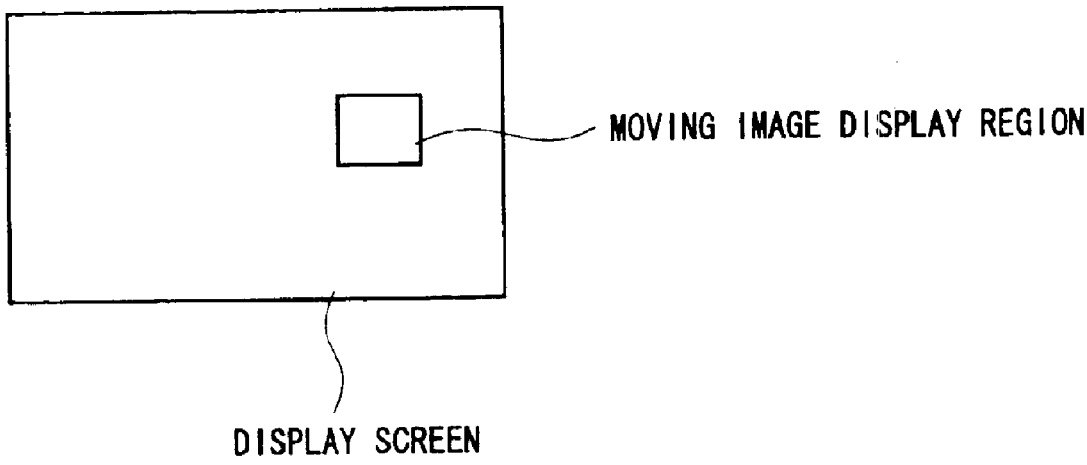
FIG. 4 is a drawing showing the reproduction of a moving image by the present invention.

The present invention is particularly provided with an area detector 14. This is effective, for example, as shown in FIG. 4, in the case of detection of a still image when a region of the screen is assigned for display of a moving image, with a moving image displayed only in this region.

The area detector 14 can be configured so that it operates simultaneously with the difference adder 12, and alternately it is possible to have it configured so that either the area detector 14 or the difference adder 12 operate selectively. As shown in FIG. 1(*c*), it is possible to have a configuration in which the area detector 14 is caused to operate as desired.

As described in detail above, a video display apparatus according to the present invention is capable of reproducing the smooth movement of an original moving image, without the occurrence of non-continuities in the moving image.

The conversion frequency detector is configured not only to calculate the number of frames for one block, but also to calculate the number of frames to be thinned, thereby eliminating the need to have a large frame memory and simplifying the algorithm used for thinning frames, while reducing the scale of the circuitry used and also simplifying the circuit configuration.

Additionally, by providing an area detector, it is possible to optimize the threshold value for determination of whether not an image captured and displayed on the personal computer is a moving image.

In addition to the above, by implementing the present invention, it is possible to eliminate the occurrence of non-continuities in the original image input to the personal computer.

What is claimed is:

1. A dot display type video display apparatus displaying an image having a first frame frequency at a second frame frequency that is lower than said first frame frequency, said video display apparatus comprising:

a synchronization signal generation circuit for generating a synchronization signal of said second frame frequency;

a conversion frequency detector for calculating a number of frames making up an unit block at each of said frame frequencies and a number of frames to be thinned based on said first frame frequency and said second frame frequency;

a frame memory for storing a first frame having said first frame frequency;

a difference detector for comparing intensity data of each dot on said video display apparatus of a second frame which is currently input to said video display apparatus with intensity data of each dot of said first frame which is stored in said frame memory and which is immediately before said second frame, and detecting a difference between said two frames;

a difference adder for counting a number of dots for a case in which said difference of said intensity data detected by said difference detector is greater than a prescribed value;

a movement detection/judgment section for distinguishing whether or not a count value detected by said difference adder is below a prescribed value and outputting a signal indicating that thinning of said second frame is possible, when said count value of said difference adder is below said prescribed value; and a frame thinning section for thinning said second frame, in a case in which said signal indicating that frame thinning of said second frame is possible is output from said movement detection/judgment section and also a signal indicating that said number of frames to be thinned is output from said conversion frequency detector.

2. A video display apparatus according to claim 1, said frame thinning section further comprising:

a frame thinning means for executing frame thinning of said second frame; and a frame thinning stopping means for stopping the frame thinning operation of said frame thinning means within a current block including said first frame and said second frame, in a case in which, if, as a result of an execution of frame thinning by said frame thinning means, a total number of thinned frames has reached said number of frames to be thinned which is output from said conversion frequency detector.

3. A video display apparatus according to claim 1, wherein an area detector for detecting movement of an image within a prescribed area on said video display apparatus is provided, and detection results of said area detector being output to said movement detection/judgment section.

4. A video display apparatus according to claim 1, wherein said video display apparatus is a plasma display apparatus.

5. A video display apparatus according to claim 1, wherein said video display apparatus is a liquid-crystal display apparatus.

6. A dot display type video display apparatus displaying an image having a first frame frequency at a second frame frequency that is lower than said first frame frequency, said video display apparatus comprising:

a synchronization signal generation circuit for generating a synchronization signal of said second frame frequency;

a conversion frequency detector for calculating a number of frames making up an unit block at each of said frame frequencies and a number of frames to be thinned based on said first frame frequency and said second frame frequency;

a frame memory for storing a first frame having said first frame frequency;

a difference detector for comparing intensity data of each dot on said video display apparatus of a second frame which is currently input to said video display apparatus with intensity data of each dot of said first frame which is stored in said frame memory and which is immediately before said second frame, and detecting a difference between said two frames;

a difference adder for counting a number of dots for a case in which said difference of said intensity data detected by said difference detector is greater than a prescribed value;

a movement detection/judgment section for distinguishing whether or not a count value detected by said difference adder is below a prescribed value and outputting a signal indicating that thinning of said second frame is possible, when said count value of said difference adder is below said prescribed value;

a frame thinning section for thinning said second frame, in a case in which said signal indicating that frame thinning of said second frame is possible is output from said movement detection/judgment section and also a signal indicating that said number of frames to be thinned is output from said conversion frequency detector; and a frame thinning stopping section for stopping the frame thinning operation of said frame thinning section within a current block including said first frame and said second frame, in a case in which, if, as a result of an execution of frame thinning by said frame thinning section, a total number of thinned frames has reached said number of frames to be thinned which is output from said conversion frequency detector.

7. A plasma display apparatus displaying an image having a first frame frequency at a second frame frequency that is lower than said first frame frequency, said video display apparatus comprising:

a synchronization signal generation circuit for generating a synchronization signal of said second frame frequency;

a conversion frequency detector for calculating a number of frames making up an unit block at each of said frame frequencies and a number of frames to be thinned based on said first frame frequency and said second frame frequency;

a frame memory for storing a first frame having said first frame frequency;

a difference detector for comparing intensity data of each dot on said video display apparatus of a second frame which is currently input to said video display apparatus with intensity data of each dot of said first frame which is stored in said frame memory and which is immediately before said second frame, and detecting a difference between said two frames;

a difference adder for counting a number of dots for a case in which said difference of said intensity data detected by said difference detector is greater than a prescribed value;

a movement detection/judgment section for distinguishing whether or not a count value detected by said difference adder is below a prescribed value and outputting a signal indicating that thinning of said second frame is possible, when said count value of said difference adder is below said prescribed value;

a frame thinning section for thinning said second frame, in a case in which said signal indicating that frame thinning of said second frame is possible is output from said movement detection/judgment section and also a signal indicating that said number of frames to be thinned is output from said conversion frequency detector; and a frame thinning stopping section for stopping the frame thinning operation of said frame thinning section within a current block including said first frame and said second frame, in a case in which, if, as a result of an execution of frame thinning by said frame thinning section, a total number of thinned frames has reached said number of frames to be thinned which is output from said conversion frequency detector.

8. A display method for a dot display type video display apparatus displaying an image having a first frame frequency at a second frame frequency that is lower than said first frame frequency, said video display apparatus comprising:

a synchronization signal generation circuit for generating a synchronization signal of said second frame frequency;

a conversion frequency detector for calculating a number of frames making up an unit block at each of said frame frequencies and a number of frames to be thinned based on said first frame frequency and said second frame frequency;

a frame memory for storing a first frame having said first frame frequency;

a difference detector for comparing intensity data of each dot on said video display apparatus of a second frame which is currently input to said video display apparatus with intensity data of each dot of said first frame which is stored in said frame memory and which is immediately before said second frame, and detecting a difference between said two frames;

a difference adder for counting a number of dots for a case in which said difference of said intensity data detected by said difference detector is greater than a prescribed value;

a movement detection/judgment section for distinguishing whether or not a count value detected by said difference adder is below a prescribed value and outputting a signal indicating that thinning of said second frame is possible, when said count value of said difference adder is below said prescribed value; and a frame thinning section for thinning said second frame, in a case in which said signal indicating that frame thinning of said second frame is possible is output from said movement detection/judgment section and also a signal indicating that said number of frames to be thinned is output from said conversion frequency detector, said method comprising the steps of:

comparing said intensity data of said first frame with that of said second frame;

thinning said second frame when said intensity data of said two frames are the same;

stopping said frame thinning operation within a current block including said first frame and said second frame, in a case in which, as a result of an execution of frame thinning, a total number of thinned frames has reached said number of frames to be thinned, which is output from said conversion frequency detector.

* * * * *